US006599221B1

(12) United States Patent
Goldwitz

(10) Patent No.: US 6,599,221 B1
(45) Date of Patent: Jul. 29, 2003

(54) FOLDABLE TRAMPOLINE

(75) Inventor: Brian L. Goldwitz, West Haven, CT (US)

(73) Assignee: Tracy Goldwitz, Orange, CT (US)

( * ) Notice: Subject to any disclaimer, the term of this patent is extended or adjusted under 35 U.S.C. 154(b) by 0 days.

(21) Appl. No.: 09/632,027

(22) Filed: Aug. 2, 2000

Related U.S. Application Data

(60) Provisional application No. 60/146,676, filed on Sep. 17, 1999, and provisional application No. 60/146,829, filed on Aug. 2, 1999.

(51) Int. Cl.[7] ..... A63B 5/11
(52) U.S. Cl. ..... 482/28; 482/27
(58) Field of Search ..... 482/27–32

(56) References Cited

U.S. PATENT DOCUMENTS

| | | | | | |
|---|---|---|---|---|---|
| 2,370,990 | A | * | 3/1945 | Nissen | |
| 2,600,572 | A | * | 6/1952 | Purviance et al. | |
| 2,969,124 | A | * | 1/1961 | Nissen | 482/27 |
| 3,339,925 | A | * | 9/1967 | Nissen | 482/27 |
| 3,501,141 | A | * | 3/1970 | Nissen | 482/27 |
| 3,502,330 | A | | 3/1970 | Cheftel | 273/1 |
| 3,580,570 | A | | 5/1971 | Fenner et al. | 272/65 |
| 4,415,151 | A | * | 11/1983 | Daniels | 272/65 |
| 4,478,420 | A | | 10/1984 | Sowards | 273/411 |
| 4,730,826 | A | * | 3/1988 | Sudmeier | 272/65 |
| 5,007,638 | A | | 4/1991 | Yukl | 273/26 |
| 5,613,922 | A | | 3/1997 | Hsiang | 473/435 |
| 5,730,666 | A | | 3/1998 | Hudson | 473/421 |
| 5,833,557 | A | * | 11/1998 | Cole | 482/27 |
| 6,135,922 | A | * | 10/2000 | Nissen | 482/27 |
| 6,162,061 | A | * | 12/2000 | Taylor | 434/253 |
| 6,237,169 | B1 | * | 5/2001 | Ying | 482/27 |

FOREIGN PATENT DOCUMENTS

| | | | | |
|---|---|---|---|---|
| DE | 19938192 A1 | * | 2/2001 | 482/27 |

* cited by examiner

*Primary Examiner*—Nicholas D. Lucchesi
*Assistant Examiner*—Lori Baker Amerson
(74) *Attorney, Agent, or Firm*—Cummings & Lockwood LLC

(57) ABSTRACT

A foldable trampoline including a resilient web, a web frame assembly and a plurality of springs includes peripheral frame members pivotally connected to each other such that the web can be positioned between a first position oriented in an approximately horizontal configuration forming a trampoline, and a second position where a portion of the web is oriented at an angle of less than 180° relative the other portion of the web to thereby form a backstop for ball games. Frame assembly members dampen the movement of the frame members relative to each other to thereby control the rate at which the trampoline is folded.

25 Claims, 18 Drawing Sheets

FIG. 6A
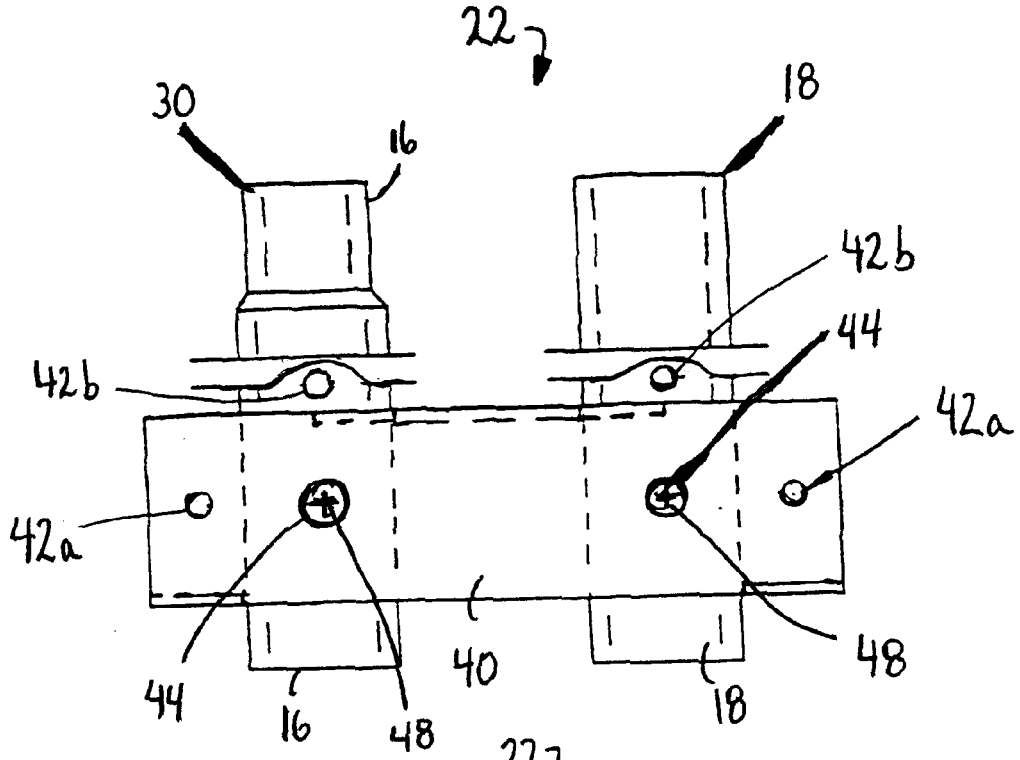
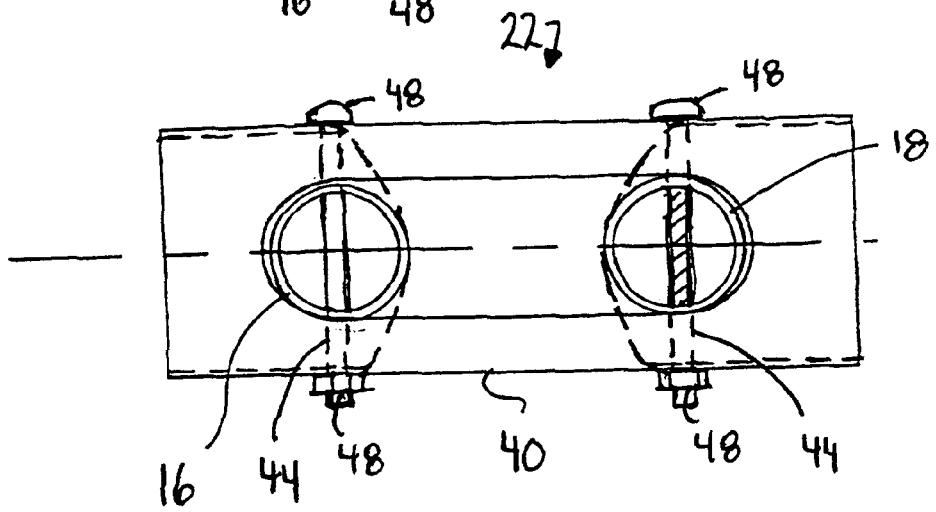
FIG. 6B

FOLDABLE TRAMPOLINE

RELATED APPLICATIONS

This application claims the benefit of U.S. Provisional Patent Applications Ser. No. 60/146,829 filed Aug. 2, 1999, and Ser. No. 60/146,676 filed Sep. 17, 1999, both of Brian L. Goldwitz, the disclosures of which are herein incorporated by reference.

FIELD OF THE INVENTION

The present invention relates to trampolines, and more particularly to a trampoline that may be folded for use as a backstop, and further folded for transportation and/or storage of the trampoline.

BACKGROUND INFORMATION

Foldable trampolines are known in the prior art. For example, U.S. Pat. No. 3,580,570 to Fenner, et al. ("the '570 Patent") shows a foldable trampoline with a base frame that can be folded so that the trampoline may be passed through a conventional doorway. One drawback associated with the trampoline shown in the '570 Patent is that the trampoline bed, which is made in an exceedingly large size, is not folded. Only the base frame is readily foldable, therefore transportation and storage remains a problem. In addition, the trampoline shown in the '570 Patent is of the type used in school gymnasiums and is not practical for individual, residential use. Another drawback associated with this and other prior art foldable trampolines is that the process of folding a trampoline in tension may cause the trampoline to unavoidably snap into a folded condition thereby causing bodily harm to one attempting to fold the trampoline.

Trampolines that may be positioned to function as a pitchback device are also known in the prior art. For example, U.S. Pat. No. 5,007,638 to Yukl and U.S. Pat. No. 5,613,922 to Hsiang show trampolines with support assemblies that can be positioned such that the trampoline surface is placed in a horizontal orientation for use as a conventional trampoline, or in a somewhat vertical orientation for use as a pitchback device. One drawback associated with these and other prior art trampolines is that the entire trampoline surface must be supported in a somewhat vertical orientation for use as a pitchback device. Accordingly, the trampoline surface area is somewhat limited thereby limiting the functionality of the trampoline surface for use as a conventional trampoline or as a backstop.

Accordingly, it is an object of the present invention to overcome these and other drawbacks and disadvantages of the prior art.

SUMMARY OF THE INVENTION

The present invention is directed toward a foldable trampoline including a resilient web, a web frame assembly and a plurality of springs connecting the resilient web to the frame assembly. The frame assembly includes peripheral frame members pivotally connected to each other such that the web can be positioned between a first position oriented in an approximately horizontal configuration forming a trampoline, and a second position where a portion of the web is oriented at an angle of less than 180° relative to the other portion of the web to thereby form a backstop for ball games. The frame assembly further includes a device for dampening the movement of the frame members relative to each other to thereby control the rate at which the trampoline is folded.

One advantage of the present invention is that the foldable trampoline can provide a relatively large surface area for use as a conventional trampoline or as a backstop. Additionally, a backstop formed by folding a trampoline according to the present invention includes a horizontal catch area as well as a vertical backstop area. Another advantage of the present invention is that the foldable trampoline can be folded at a controlled rate to prevent an injury that may otherwise be caused when a foldable trampoline is folded and a trampoline surface is maintained in tension.

Other objects and advantages of the present invention will become apparent in view of the following detailed description of the preferred embodiments and accompanying drawings.

BRIEF DESCRIPTION OF THE DRAWINGS

FIG. 6A is a side elevational view of a pivot joint of the trampoline of FIG. 4, showing the pivot joint in a folded condition.

FIG. 6B is a bottom plan view of the pivot joint of FIG. 6A.

DETAILED DESCRIPTION OF THE PREFERRED EMBODIMENTS

Figure 1:
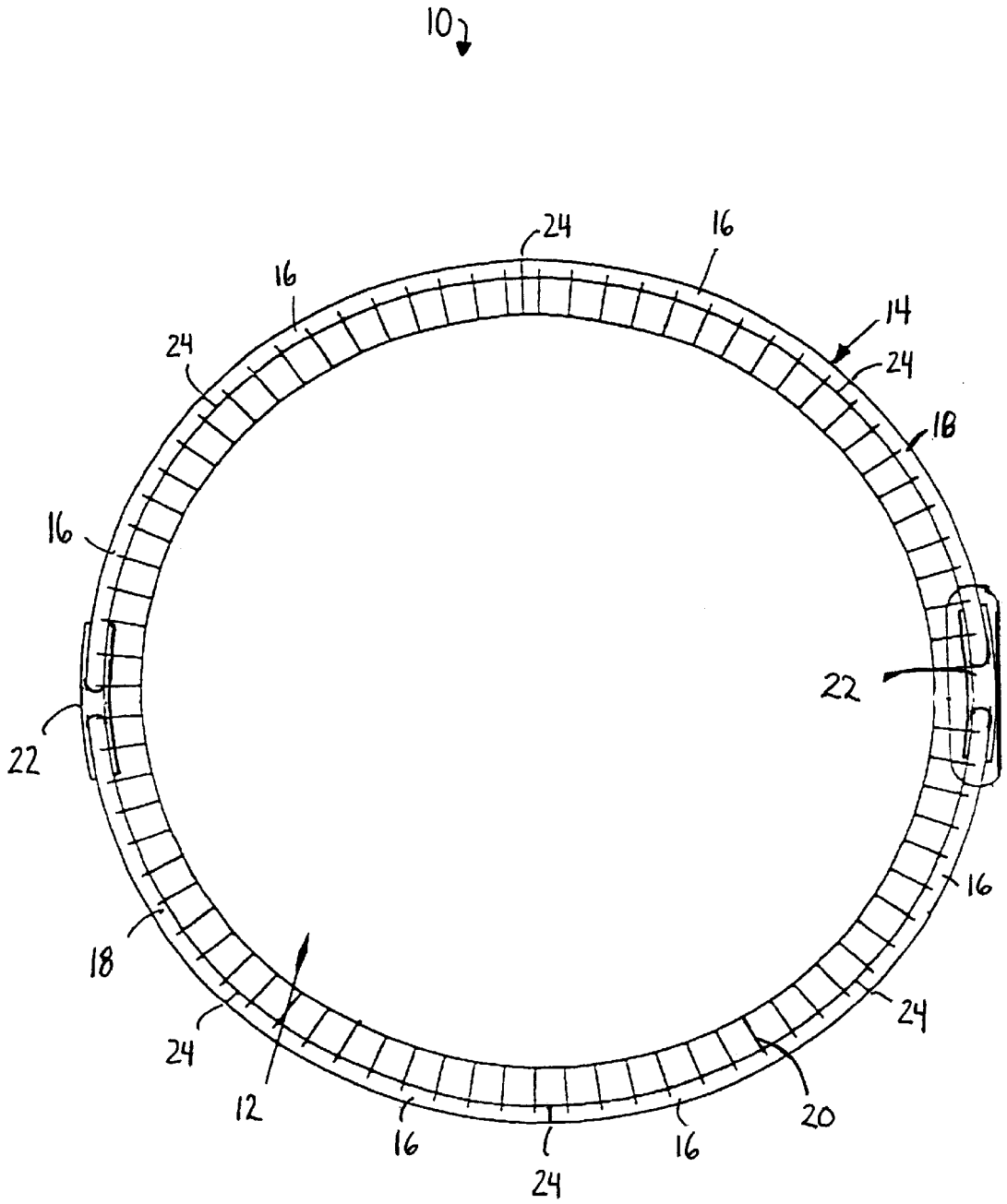
FIG. 1 is a top plan view of a trampoline of the present invention.

As shown in FIG. 1, a trampoline 10 of the present invention comprises a resilient web 12, a web frame assembly 14, and a plurality of springs 20 connecting the resilient web 12 to the web frame assembly 14. The web frame assembly 14 includes a plurality of first peripheral frame members 16 spaced relative to each other to form a shape, such as a circle, corresponding to the periphery of the shape of the resilient web 12. The web frame assembly 14 further includes at least one second peripheral frame member 18 located adjacent to a first peripheral frame member 16. The first and second peripheral frame members 16 and 18 are pivotally connected at one end to each other at pivot joint 22 such that one of the first or second peripheral frame members 16 and 18 are pivotable relative to the other. The first and second peripheral frame members 16 and 18 are fixedly connected at another end to each other at joint 24 such that the first and second peripheral frame members 16 and 18 are fixedly connected to one another when the trampoline is in either a folded or unfolded condition.

Figure 2:
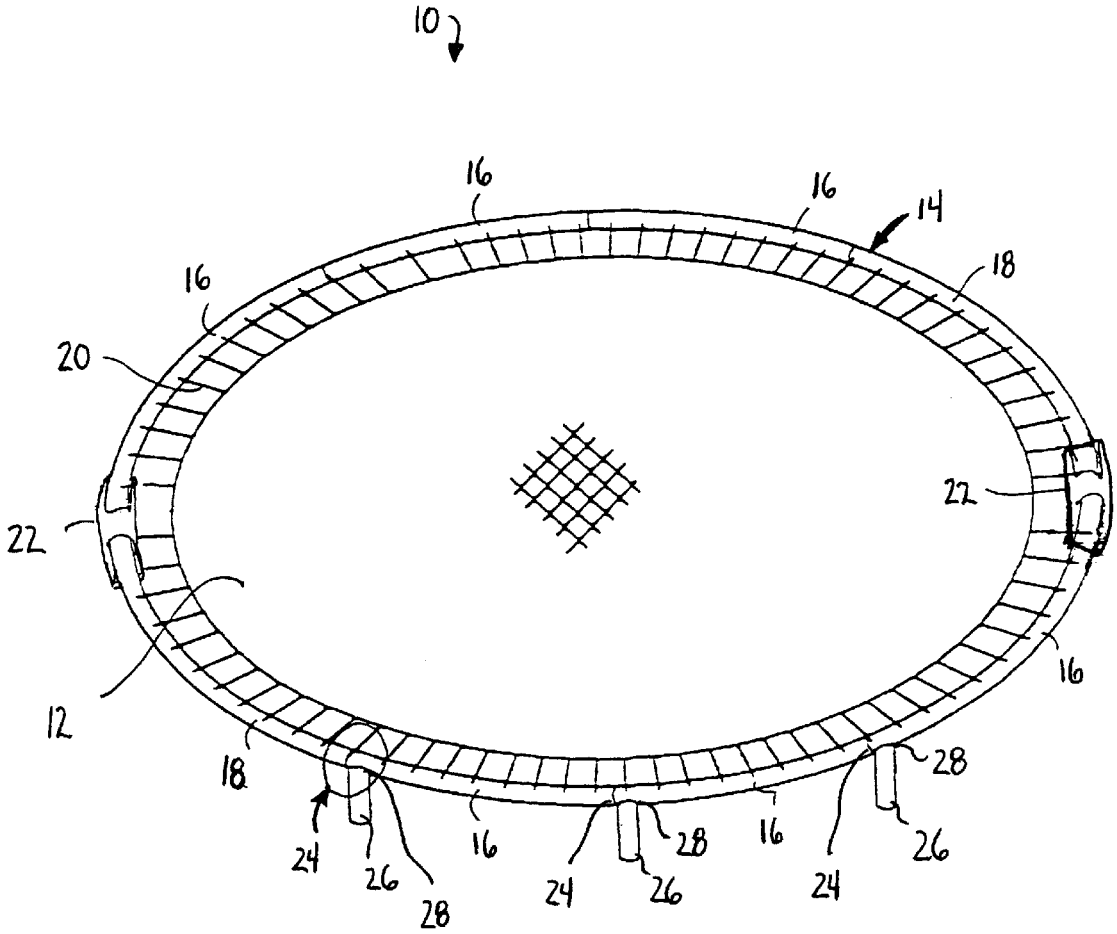
FIG. 2 is a top perspective view of the trampoline of FIG. 1.

As shown in FIG. 2, the web frame assembly 14 further includes a plurality of base frame members 26 extending downwardly from the first peripheral frame members 16. The base frame members 26 are slidably received in corresponding sockets 28 in one end of each first peripheral frame member 16. Accordingly, base frame members 26 are detachably mounted to the web frame assembly 14 such that the base frame members 26 locate the resilient web 12 in spaced relation and approximately parallel to the surface on which the base frame members 26 rest.

Figure 3:
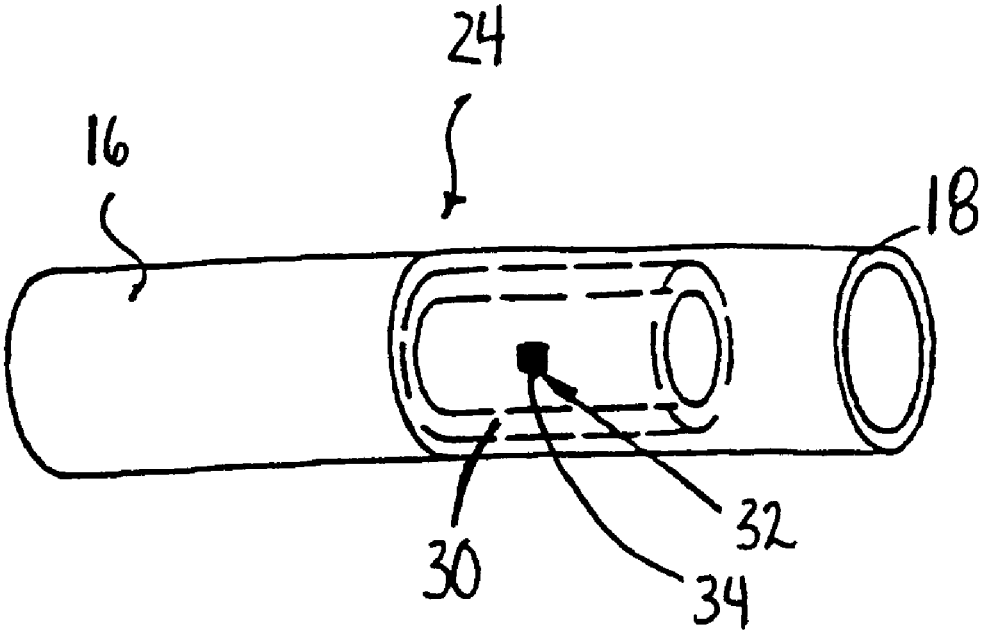
FIG. 3 is an enlarged perspective view of a portion of a frame assembly contained in circle 3 of the trampoline of FIGS. 1 and 2, as viewed from the inside of the circle formed by the trampoline frame assembly.

As shown in FIG. 3, each first peripheral frame member 16 is fixedly connected to one another, or to a second peripheral frame member 18, at a non-bending joint 24. Each first peripheral frame member 16 includes an insert 30 on one end that is slidably received into an end of another first peripheral frame member 16 that does not include an insert 30. Similarly, and as shown in FIG. 3 as an example, a first peripheral frame member 16 includes an insert 30 on one end that is slidably received into a second peripheral frame member 18. The insert 30 and the respective end of a first peripheral frame member 16 or a second peripheral frame member 18 further include corresponding apertures 32 for receiving any one of numerous known fastening means 34, such as for example, a cotter pin, or a nut and bolt assembly to thereby fixedly secure the web frame members to one another.

Figure 4:
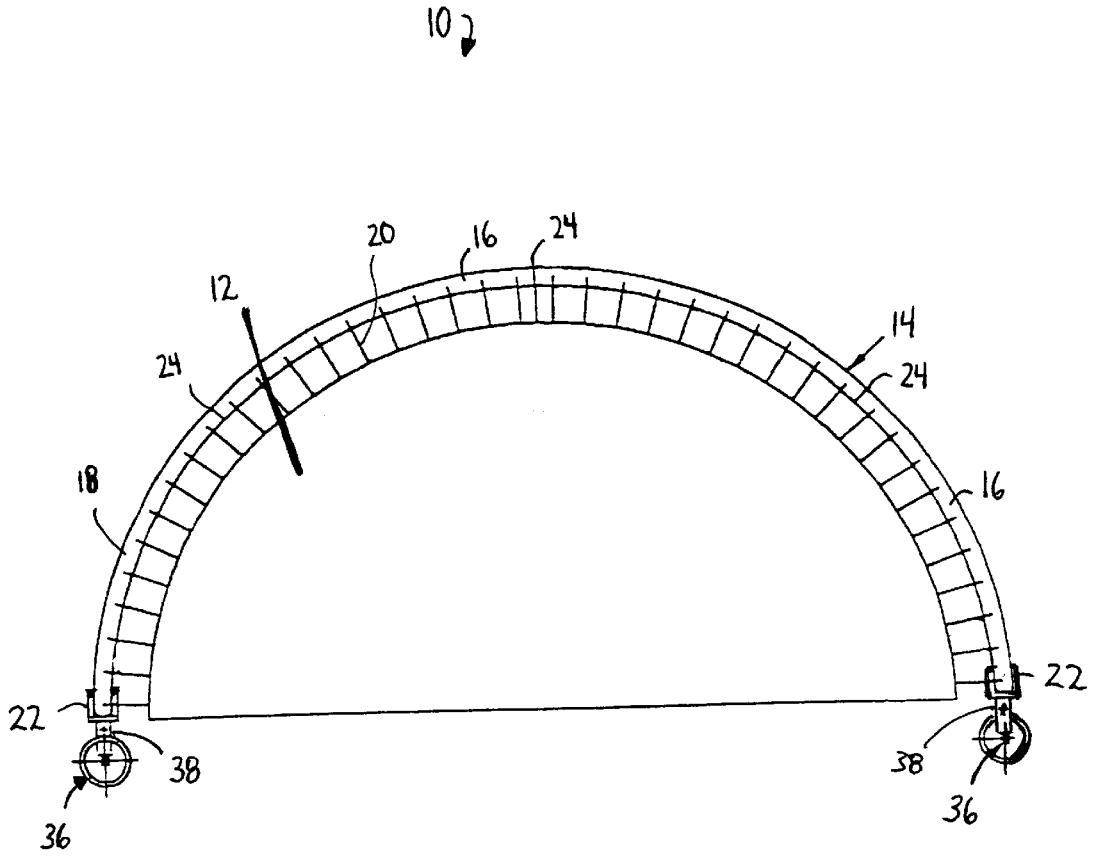
FIG. 4 is a side elevational view of the trampoline of FIGS. 1 and 2 in a folded condition.

The trampoline 10 of the present invention can be folded as shown in FIG. 4. As described above, the first and second peripheral frame members 16 and 18 are pivotally connected to each other such that one peripheral frame member is pivotable relative to the other. Accordingly, the resilient web 12 and the web frame assembly 14 can be positioned in a first position wherein the first and second peripheral frames 16 and 18 and the resilient web 12 connected thereto are oriented in an approximately horizontal configuration forming a trampoline as shown in FIGS. 1 and 2. Alternatively, the resilient web 12 and the web frame assembly 14 can be positioned in a second position wherein one of the first and second peripheral frames 16 and 18, and an associated portion of the resilient web 12 connected thereto, are oriented at an angle of less than 180° relative to the other of the first and second peripheral frames 16 and 18, and the associated portion of the resilient web 12 connected thereto, to thereby form a back stop for ball games. Additionally and as further shown in FIG. 4, the web frame assembly 14 can include wheel assemblies 36 rotatably connected to the web frame assembly 14 at pivot joints 38 described in more detail below.

Figure 5B:
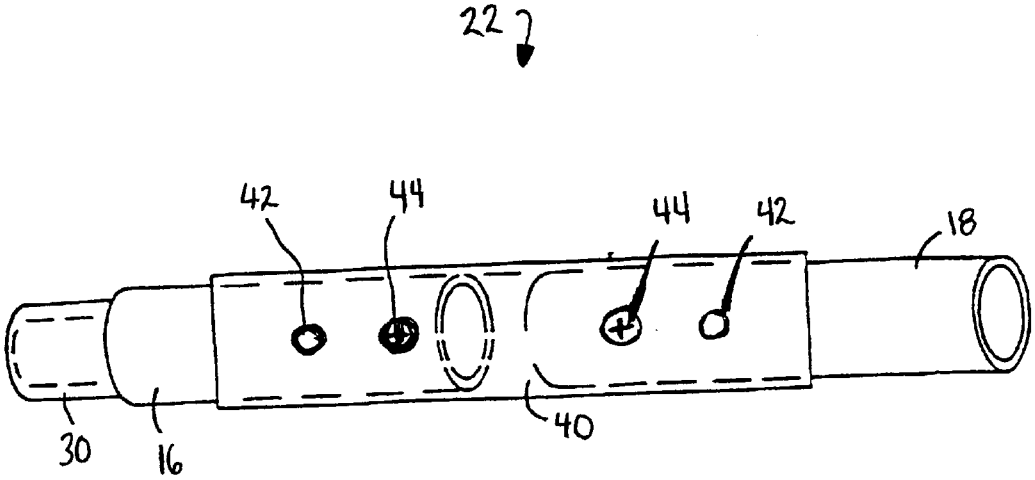
FIG. 5B is a side elevational view of the pivot joint of FIG. 5A.
Figure 5A:
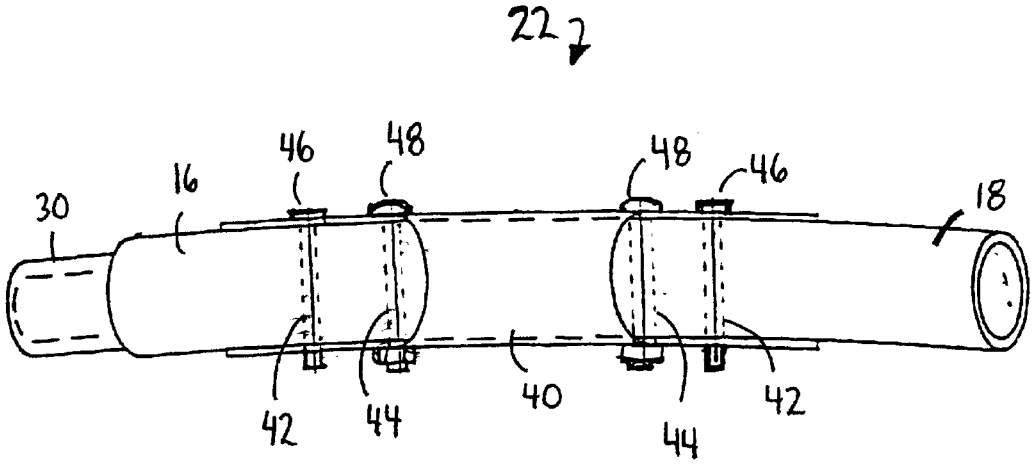
FIG. 5A is an enlarged top plan view of a pivot joint of the trampoline of FIGS. 1 and 2.

Turning to FIGS. 5A and 5B, a pivot joint 22 is shown in an unfolded condition. As described above, one end of a first peripheral frame member 16 includes an insert 30 for connecting respective members of the web frame assembly 14 to one another. A second end of a first peripheral frame member 16 is pivotally connected to a first end of a sleeve 40, and one end of a second peripheral frame member 18 is pivotally connected to the second end of sleeve 40 to thereby pivotally connect a first and second peripheral frame member 16 and 18 to one another. The second end of the first peripheral frame member 16 and the first end of a sleeve 40 include corresponding apertures 42 and 44 for respectively receiving any one of numerous known fastening means 46 and 48, such as for example, a cotter pin, or a nut and bolt assembly to thereby fixedly secure the first peripheral frame member 16 to sleeve 40. Similarly, one end of the second peripheral frame member 18 and the second end of a sleeve 40 include corresponding apertures 42 and 44 for respectively receiving any one of numerous known fastening means 46 and 48 as previously described to thereby fixedly secure the second peripheral frame member 18 to sleeve 40.

In a preferred embodiment of the invention, fastening means 46 is readily detachable, while fastening means 48 is relatively fixedly secured to the web frame members. By detaching and removing fastening means 46, the respective first or second peripheral frame member 16 or 18 can be pivotally moved relative to sleeve 40 about fastening means 48. Accordingly, a respective first or second peripheral frame member 16 or 18 can be pivotally moved relative to the other of the first or second peripheral frame member 16 or 18. FIGS. 6A and 6B show a pivot joint 22 in a folded condition wherein the fastening means 46 have been moved from respective apertures 42*a* in sleeve 40 and apertures 42*b* in each of the first and second peripheral frame members 16 and 18.

Figure 7:
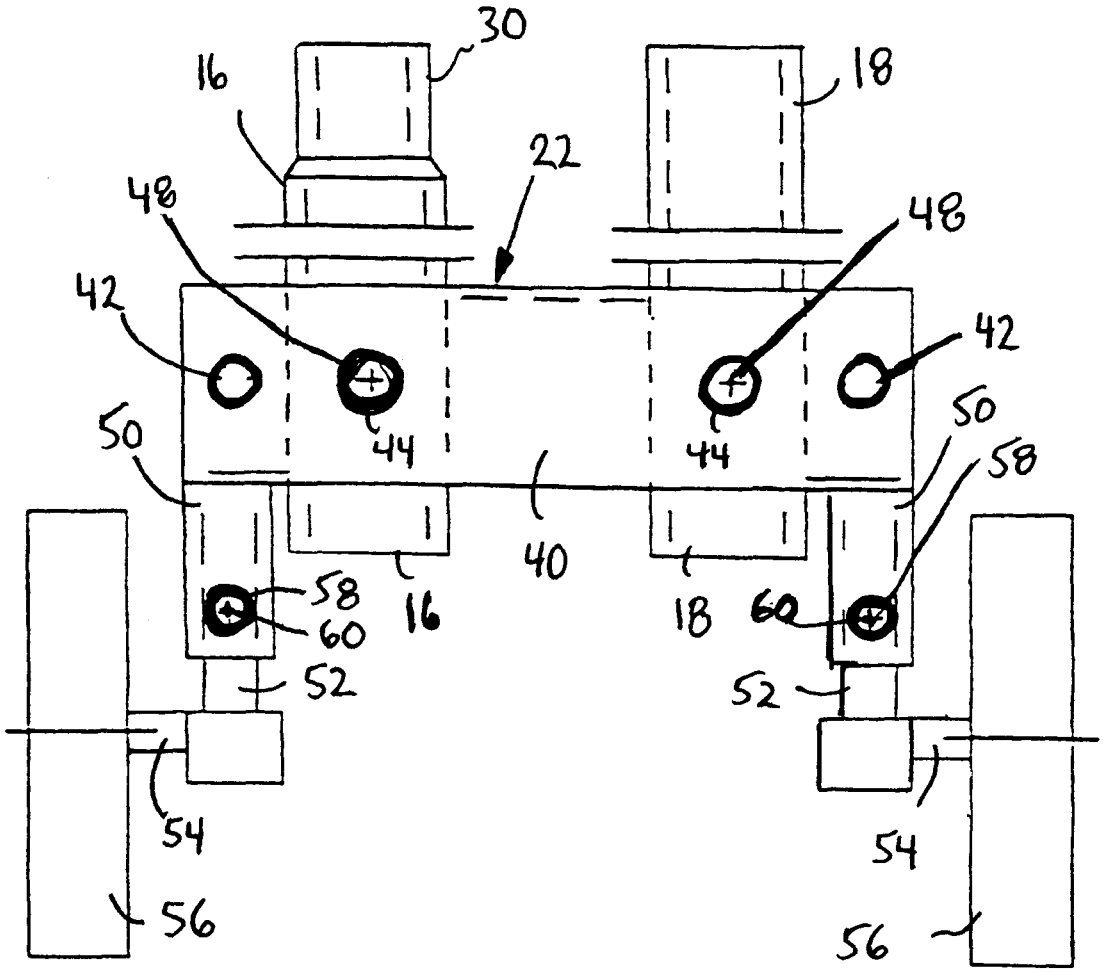
FIG. 7 is a side elevational view of another embodiment of a pivot joint of the trampoline of FIG. 4, showing the pivot joint in a folded condition with wheel assemblies attached thereto.
Figure 8:
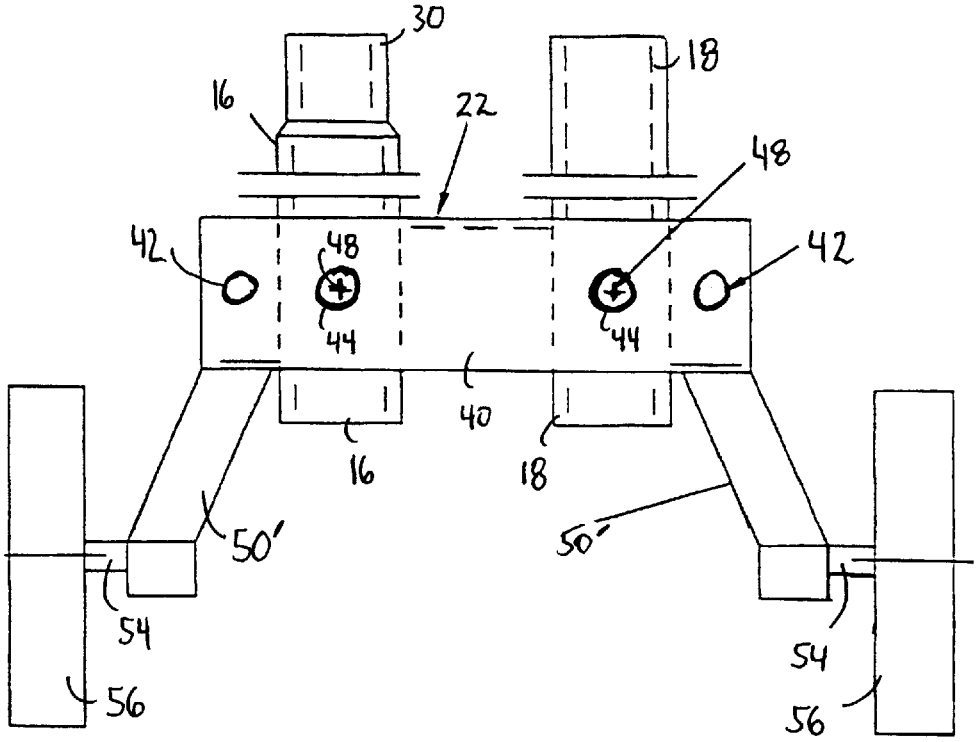
FIG. 8 is a side elevational view of another embodiment of the pivot joint of FIG. 7.

In one embodiment of the present invention and as shown in FIG. 7, wheel assemblies can be rotatably attached to each pivot joint 22 to facilitate transportation of a trampoline of the present invention. The sleeve 40 includes a support 50 and an extension 52 for locating and holding a wheel axle 54 and a wheel 56 connected thereto. Each of the support 50 and extension 52 include corresponding apertures 58 for respectively receiving any one of numerous known fastening means 60, such as for example, a cotter pin, or a nut and bolt assembly to thereby fixedly secure the extension 52 to the support 50. Another embodiment of a wheel assembly 36 attached to a pivot joint 22 is shown in FIG. 8 wherein the wheel axle 54 is attached directly to the support 50'.

Figure 9:
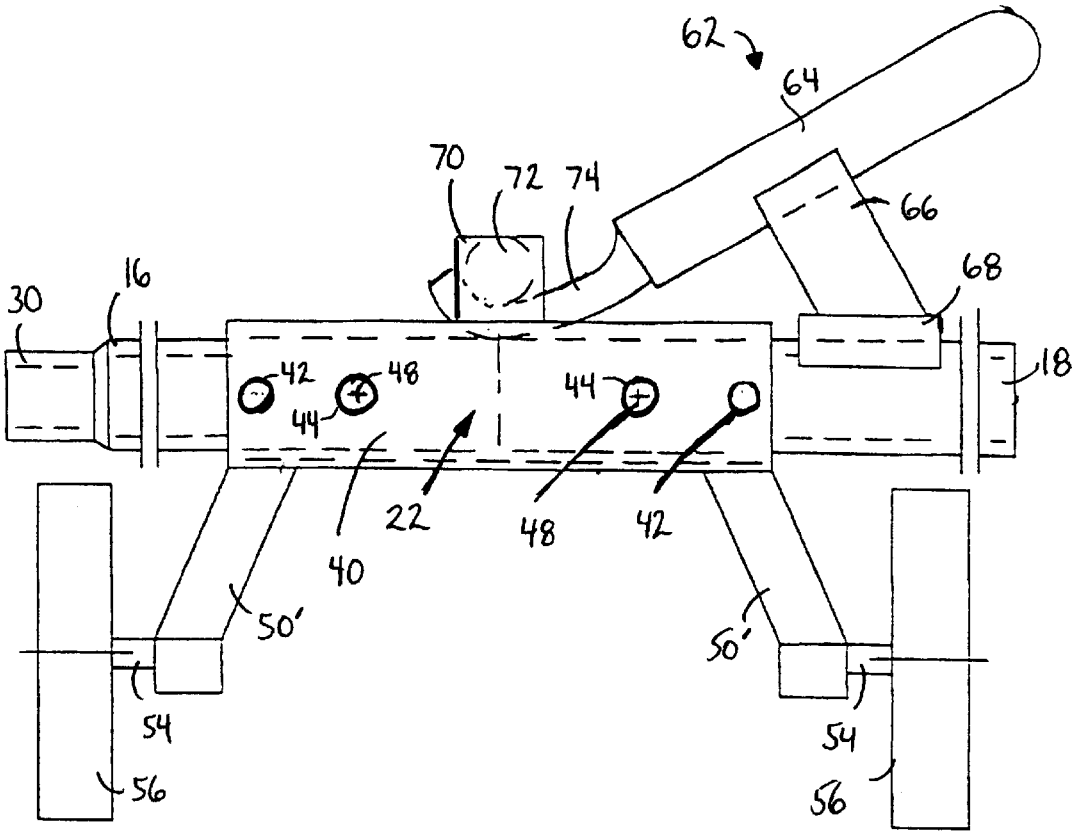
FIG. 9 is a side elevational view of another embodiment of the pivot joint of FIG. 5B, showing the pivot joint in an unfolded condition with wheel assemblies attached thereto.

Turning to FIG. 9, a locking mechanism 62 can be employed to prevent a pivot joint 22 from folding. The locking mechanism 62 includes a locking member 64 and a brace 66 attached at one end thereto. The second end of the brace 66 includes a seat 68 corresponding to the shape of a first or second peripheral frame member 16 or 18, and formed to frictionally engage a first or second peripheral frame member 16 or 18 as shown in FIG. 9. Sleeve 40 includes a bracket 70 located on the top portion of sleeve 40, and bracket 70 includes a cylindrical member 72 formed to frictionally engage one end 74 of locking member 64. By frictionally engaging cylindrical member 72 with end 74 of locking member 64, and by frictionally engaging a portion of a first or second peripheral frame member 16 or 18 with seat 68, locking mechanism 62 is detachably secured to pivot joint 22 and web frame assembly 14 such that the trampoline 10 cannot be folded until locking mechanism 62 is detached.

Figure 10:
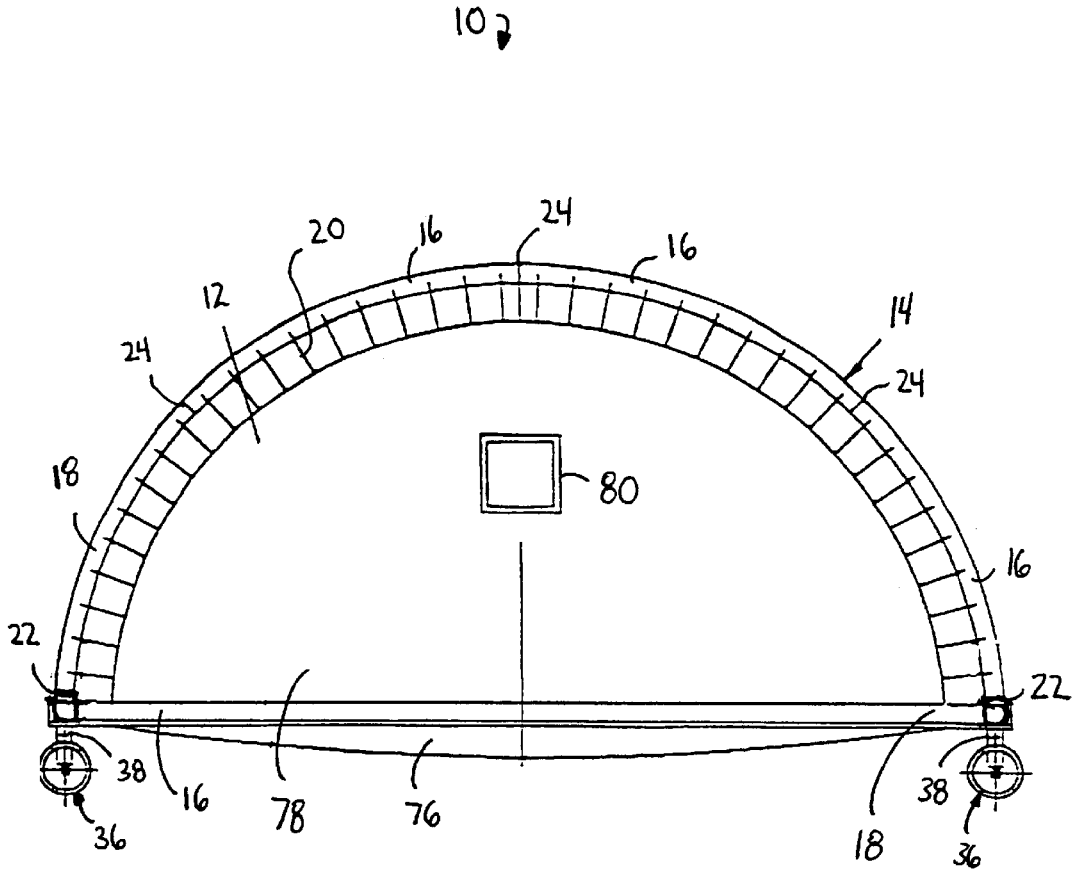
FIG. 10 is a side elevational view of the trampoline of FIGS. 1 and 2, with wheel assemblies attached thereto, in a folded condition, and including a target box secured to the trampoline to facilitate the use of the folded trampoline as a backstop.

A foldable trampoline of the present invention, when in a folded condition, is suitable for providing a backstop for a variety of activities such as pitching a baseball or serving a tennis ball. As shown in FIG. 10, a trampoline 10 can be folded such that a first peripheral frame member 16 and an associated portion 76 of the resilient web 12 is oriented approximately horizontal, and a second peripheral frame member 18 and an associated portion 78 of the resilient web 12 is oriented upwardly approximately 90° relative to the first position to thereby form a backstop. As further shown in FIG. 10, a target box 80 can be secured to the portion 78 of resilient web 12 in such a location whereby, when oriented approximately vertical, the target box 80 provides a suitable target for the desired backstop activity.

Turning to FIGS. 11 through 17, another embodiment of a web frame assembly 100 of a foldable trampoline of the present invention is shown. The web frame assembly 100 includes a base frame member 110, a first peripheral frame member 112, a second peripheral frame member 114, and connecting frame members 116 and 118. A first end 120 of connecting frame member 116 is pivotally connected to the base frame member 110 at pivot joint 122, and a second end 124 of connecting frame member 116 is pivotally connected to the first peripheral frame member 112 at pivot joint 126. Similarly, a first end 128 of connecting frame member 118 is pivotally connected to the base frame member 110 at pivot joint 130, and a second end 132 of connecting frame member 118 is pivotally connected to the second peripheral frame member 114 at pivot joint 134.

Base frame member 110 includes brackets 136 and 138 to respectively form pivot joints 122 and 138. One end 120 of connecting frame member 116 and bracket 136 include corresponding apertures 140 for respectively receiving any one of numerous known fastening means 142, such as for example, a cotter pin, or a nut and bolt assembly to thereby pivotally connect connecting frame member 116 to bracket 136. Similarly, one end 128 of connecting frame member 118 and bracket 138 include corresponding apertures 144 for respectively receiving any one of numerous known fastening means 146 as previously described to thereby pivotally connect connecting frame member 118 to bracket 138.

First peripheral frame member 112 includes bracket 148, and second peripheral frame member 114 includes bracket 150 to respectively form pivot joints 126 and 134. One end 124 of connecting frame member 116 and bracket 148 include corresponding apertures 151 for respectively receiving any one of numerous known fastening means 153 as previously described to thereby pivotally connect connecting frame member 116 to bracket 148. Similarly, one end of first peripheral frame member 112 and bracket 148 include corresponding apertures 152 for respectively receiving any one of numerous known fastening means 154 as previously described to thereby pivotally first peripheral frame member 112 to bracket 148. One end 132 of connecting frame member 118 and bracket 150 include corresponding apertures 155 for respectively receiving any one of numerous known fastening means 157 as previously described to thereby pivotally connect connecting frame member 118 to bracket 150. Similarly, one end of second peripheral frame member 114 and bracket 150 include corresponding apertures 156 for respectively receiving any one of numerous known fastening means 158 as previously described to thereby pivotally second peripheral frame member 114 to bracket 150.

Figure 11:
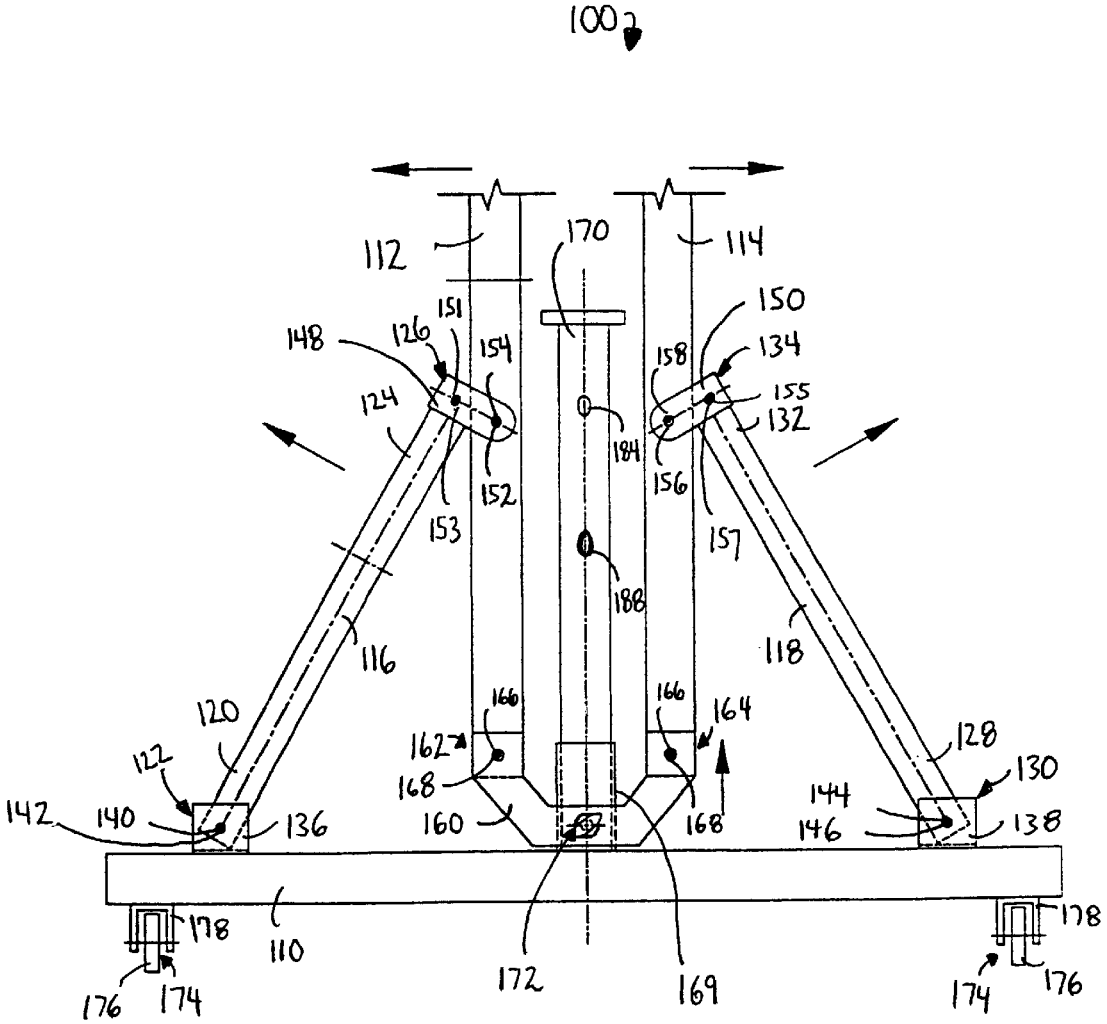
FIG. 11 is a partial side elevational view of another embodiment of a trampoline of the present invention in a folded condition.

The web frame assembly 100 of FIG. 11 further includes a center frame member 160 pivotally connected to first and second peripheral frame members 112 and 114 respectively at pivot joints 162 and 164. One end each of first and second peripheral frame members 112 and 114, and both ends of center frame member 160 include corresponding apertures 166 for respectively receiving any one of numerous known fastening means 168 as previously described to thereby pivotally connect first and second peripheral frame members 112 and 114 respectively to center frame member 160.

Center frame member 160 further includes sleeve 169 for slidably receiving a center frame post 170. Center frame member 160 may be located at any position along center frame post 170, and releasably secured thereto by locking assembly 172. Lastly, the web frame assembly 100 of FIG. 11 includes wheel assemblies 174, each wheel assembly 174 including a wheel 176 and a housing 178. Each housing 178 is mounted to the side of base frame member 110 opposite the side including brackets 136 and 138, and spaced on opposite ends of base frame member 110 as shown in FIG. 11 to thereby rotatably attach wheel assemblies 174 to base frame member 110.

Figure 12:
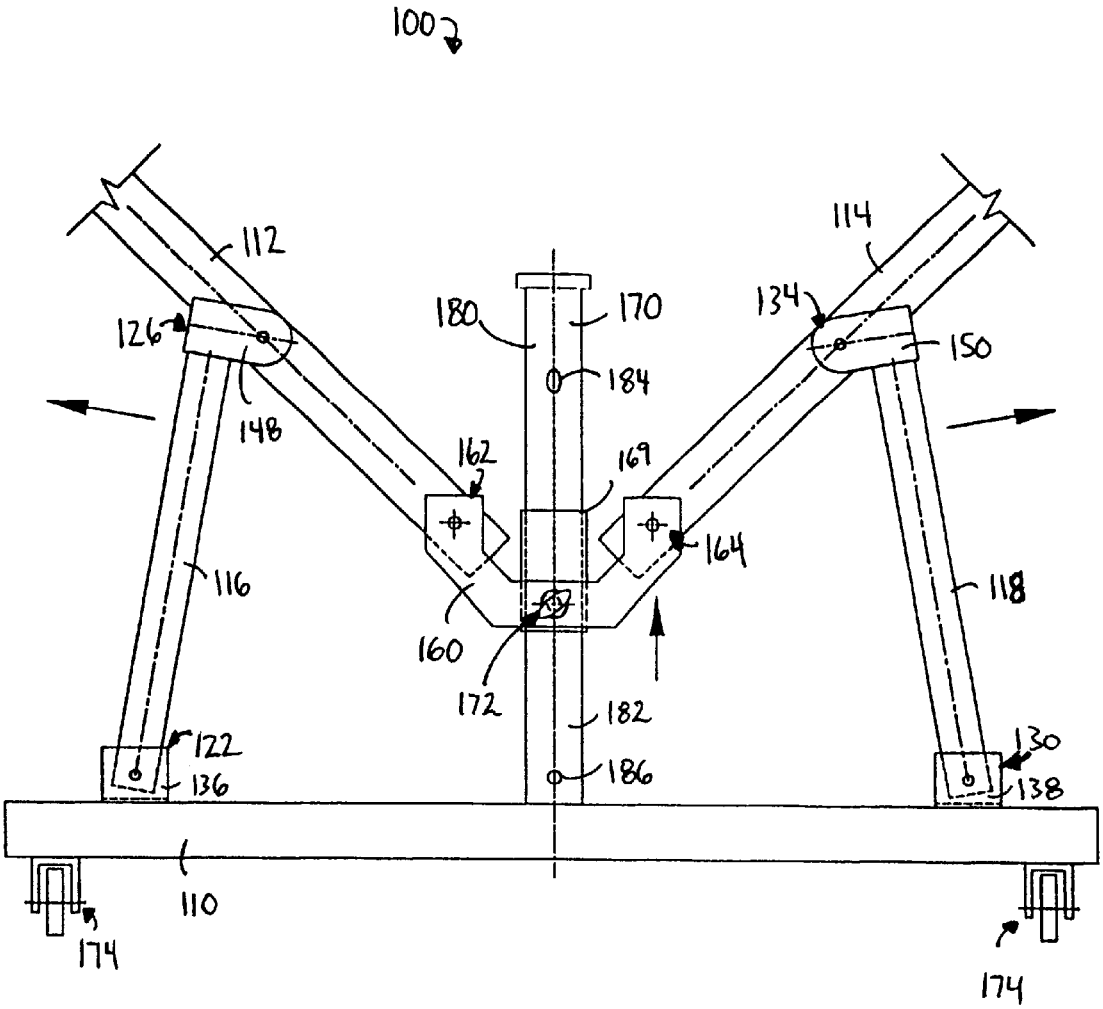
FIG. 12 is a partial side elevational view of the trampoline of FIG. 11 in a partially folded condition.

As shown in FIG. 12, center frame member 160 can be raised relative to a first end 180 of center frame post 170. By releasing locking mechanism 172, described more fully below, from aperture 186 at a second end 182 of center frame post 170, center frame member 160 can be raised to such a position whereby locking mechanism 172 can engage aperture 184 in a first end 180 of center frame post 170, or aperture 188 located approximately halfway from first and second ends 180 and 182 of center frame post 170. As shown in FIG. 12, the various frame members of web frame assembly 100 move relative to each other about each respective pivot joint described above. Accordingly, center frame member 160 can be located on center frame post 170 such that locking mechanism 172 engages aperture 188 to thereby position first peripheral frame member 112, and an associated portion of a resilient web, approximately 90° relative to second peripheral frame member 114, and an associated portion of a resilient web.

Figure 13:
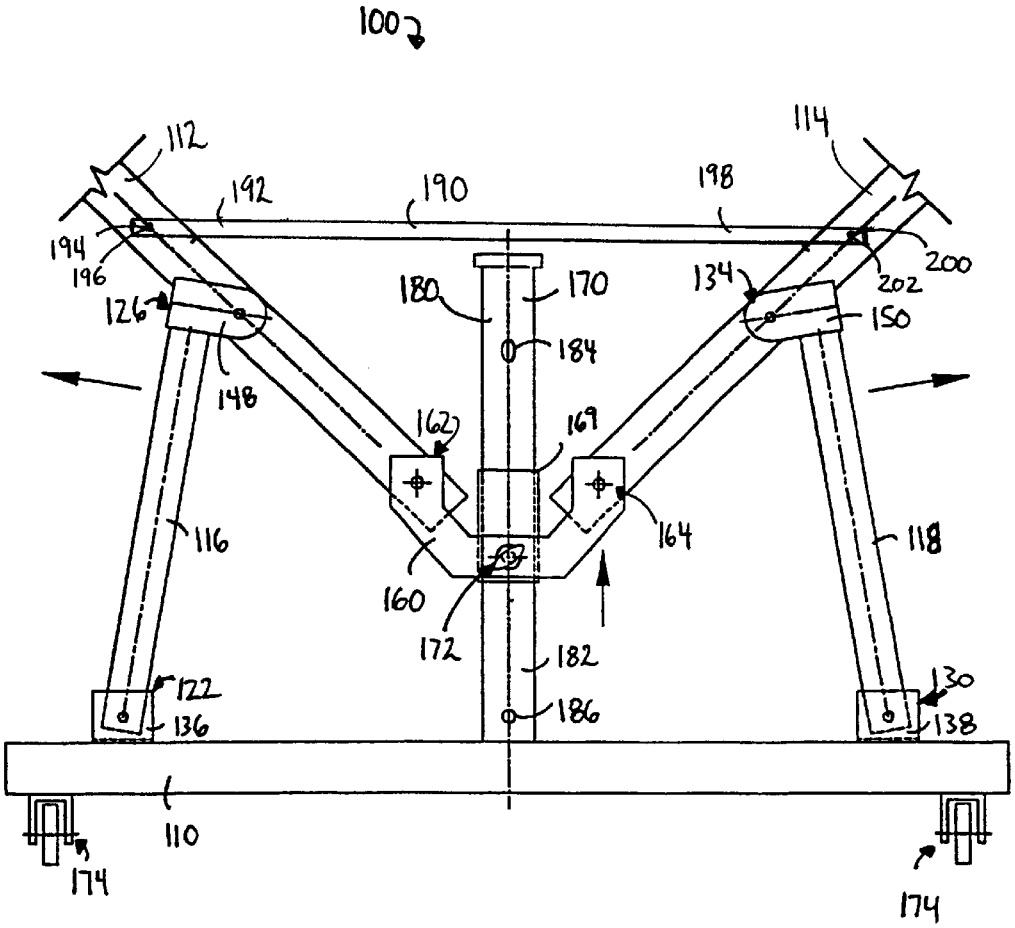
FIG. 13 is a partial side elevational view of the trampoline of FIGS. 11 and 12 locked in a partially folded condition to facilitate the use of the folded trampoline as a backstop.

As shown in FIG. 13, a lateral frame member 190 can be releasably connected to first and second peripheral frame members 112 and 114 to releasably secure the peripheral frame members in an orientation approximately 90° relative to each other. A first end 192 of lateral frame member 190 and first peripheral frame member 112 include corresponding apertures 194 for respectively receiving any one of numerous known fastening means 196 as previously described to thereby releasably connect lateral frame member 190 to first peripheral frame member 112. Similarly, a second end 198 of lateral frame member 190 and second peripheral frame member 114 include corresponding apertures 200 for respectively receiving any one of numerous known fastening means 202 as previously described to thereby releasably connect lateral frame member 190 to second peripheral frame member 114.

Figure 14:
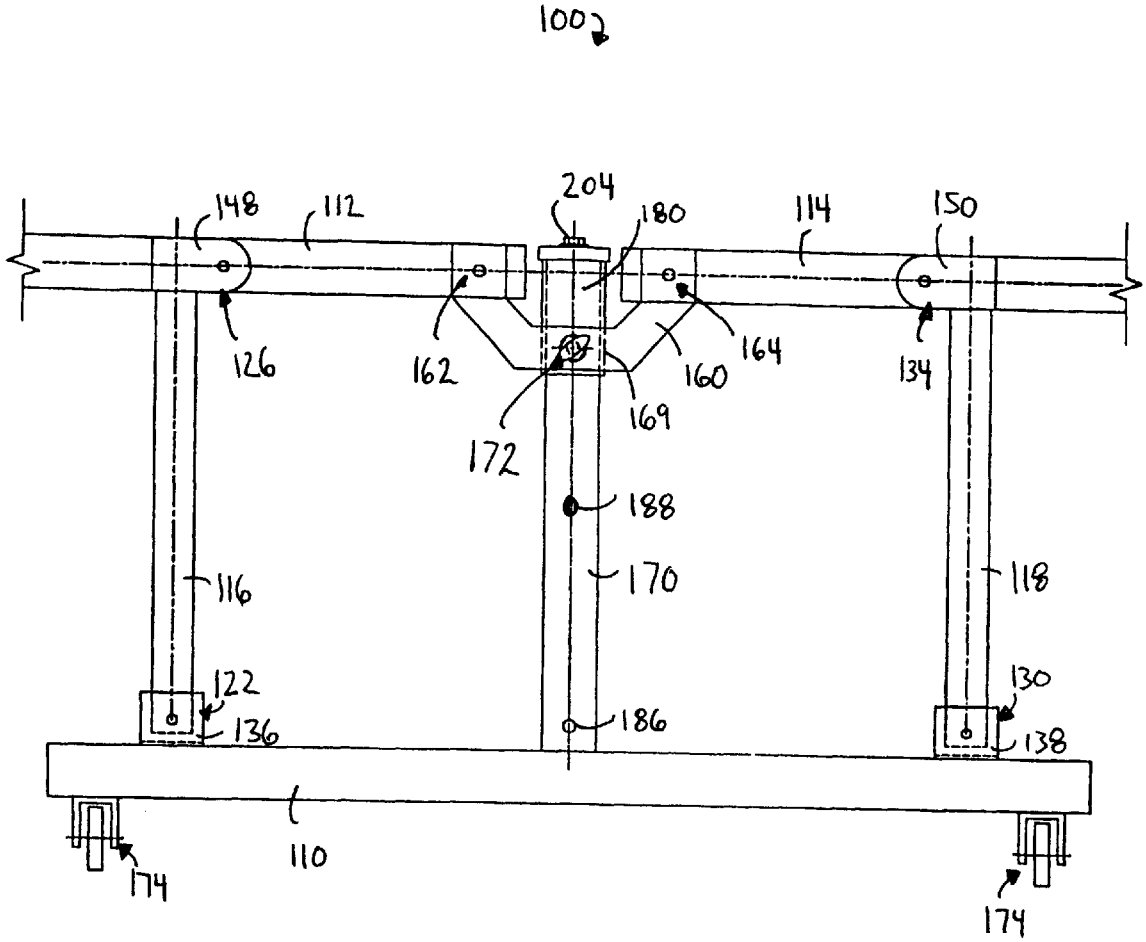
FIG. 14 is a partial side elevational view of the trampoline of FIGS. 11 and 12 in an unfolded condition for use as a conventional trampoline.

As shown in FIG. 14, by detaching lateral frame member 190, center frame member 160 can be raised relative to first end 180 of center frame post 170 to such a position whereby locking mechanism 172 can engage aperture 184 in first end 180 of center frame post 170. Accordingly, web frame assembly 100 is placed and locked in an unfolded condition to place a resilient web in a conventional trampoline position.

Figure 15:
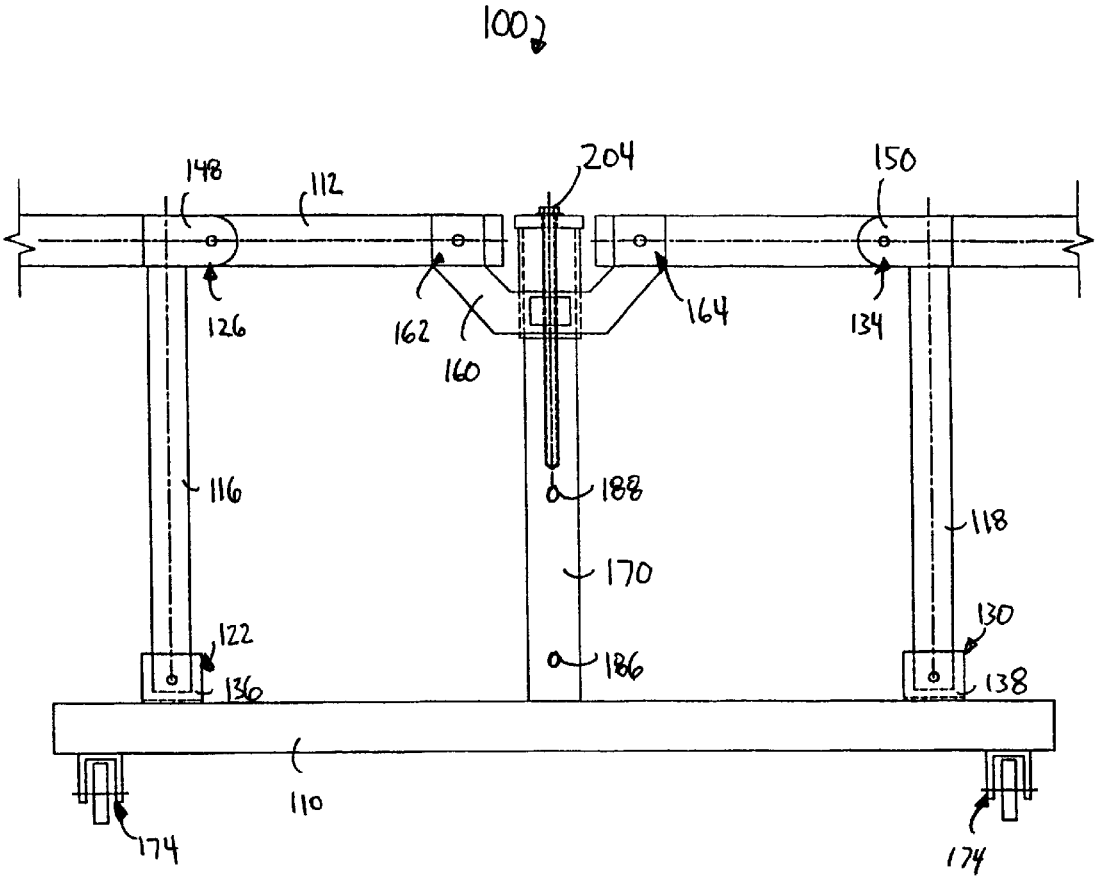
FIG. 15 is a partial side elevational view of the trampoline of FIG. 14 showing a mechanism for safely folding the trampoline.

A preferred embodiment of the present invention shown in FIG. 15 includes a device for safely folding the trampoline. Center frame post 170 includes a screw mechanism 204 threadedly received through center frame member 160 such that center frame member 160 can be moved relative to center frame post 170 only by turning screw mechanism 204 in a clockwise or counter-clockwise direction. As shown in detail in FIG. 16, screw mechanism 204 is threadedly received through center frame member 160. As screw mechanism 204 is turned, center frame member 160 is correspondingly raised or lowered relative to center frame post 170.

Figure 17:
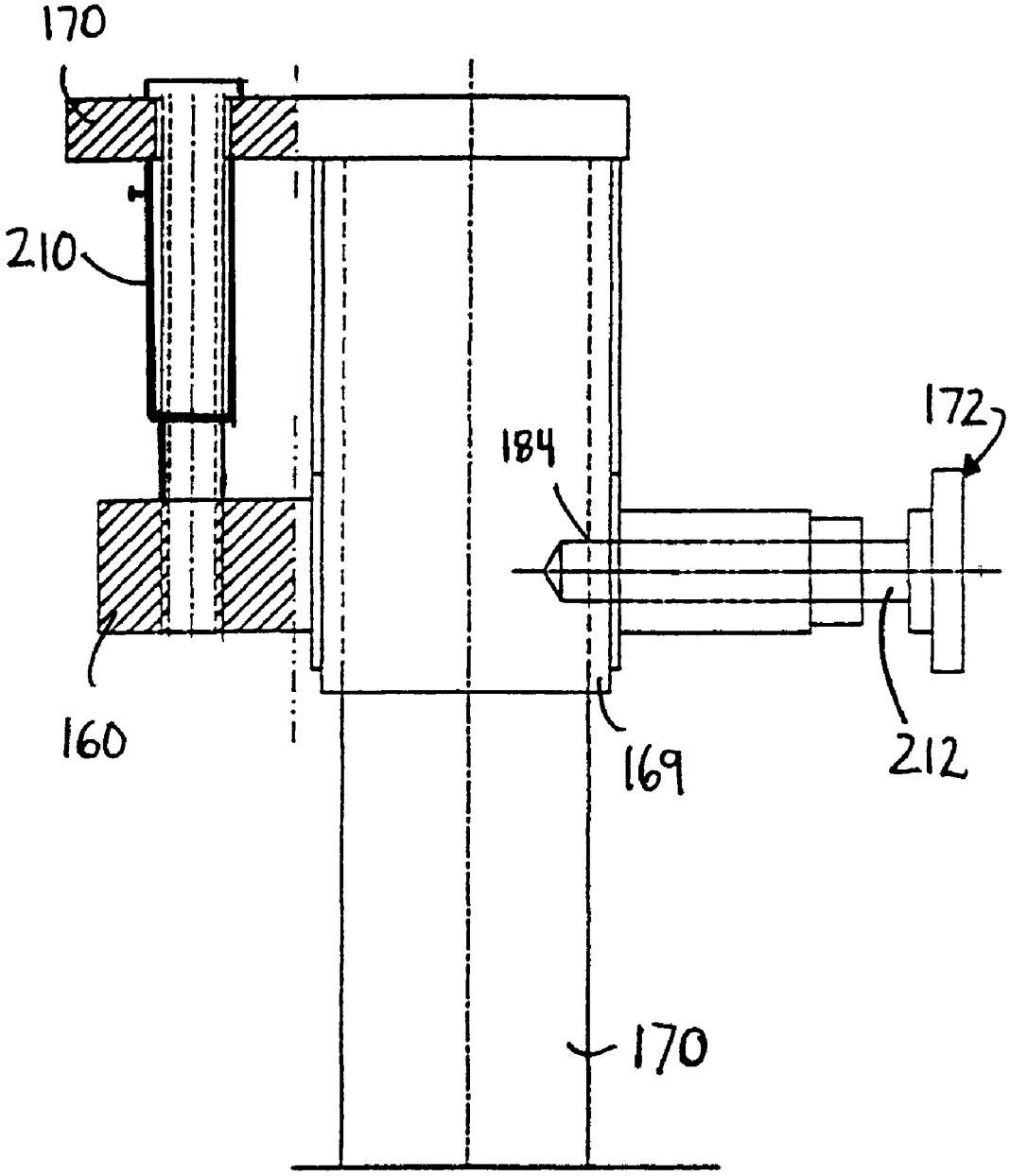
FIG. 17 is front elevational view, partially in schematic, of another embodiment of the folding mechanism of FIG. 15.
Figure 18:
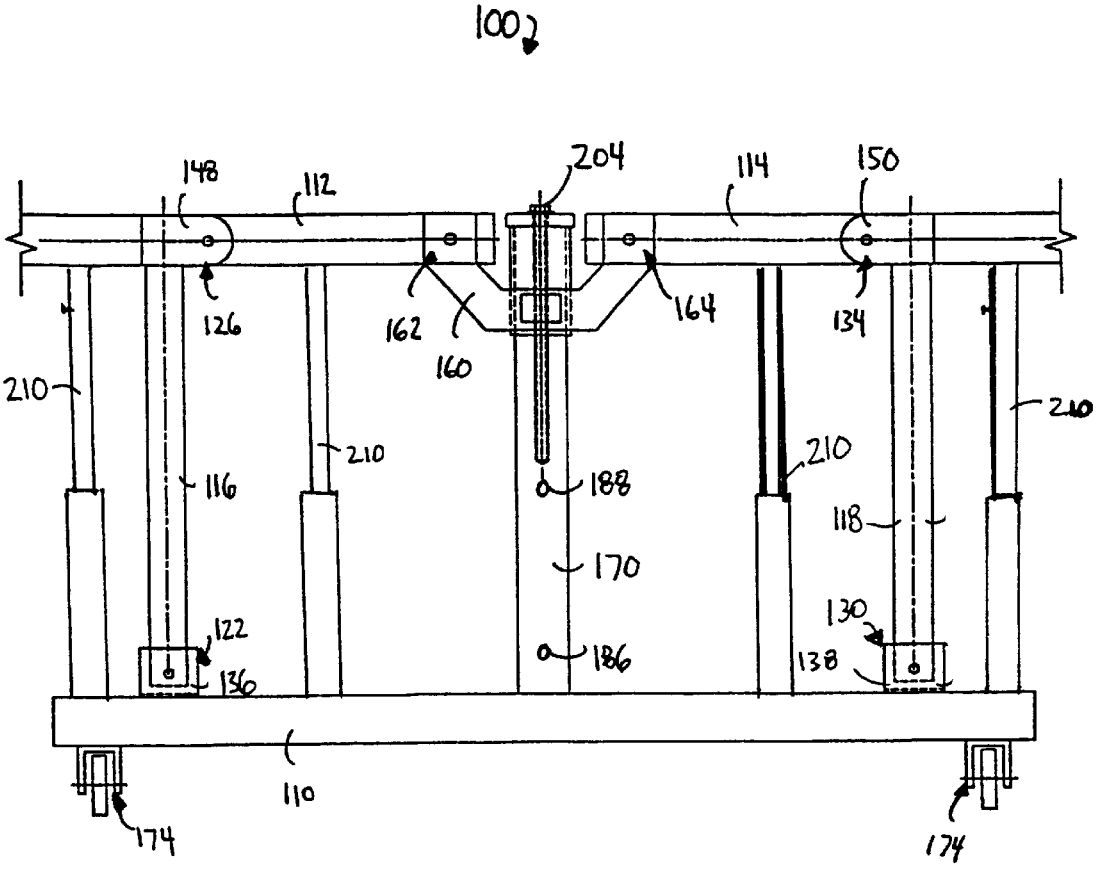

Another embodiment of a mechanism for safely folding the trampoline is shown in FIG. 17 wherein center frame post 170 includes a hydraulic cylinder 210 to dampen and slow the movement of center frame member 160 relative to center frame post 170. The hydraulic cylinder 210 is connected at one end to center frame member 160, and connected at another end to center frame post 170 such that movement of center frame member 160 along center frame post 170 is effectively dampened. Alternatively and as shown in FIG. 18, hydraulic cylinder 210 can be connected to base frame 110 and first peripheral frame member 112, on either side of connecting frame member 116. Similarly, hydraulic cylinder 210 can be connected to base frame 110 and second peripheral frame member 114, on either side of connecting frame member 118.

Figure 16:
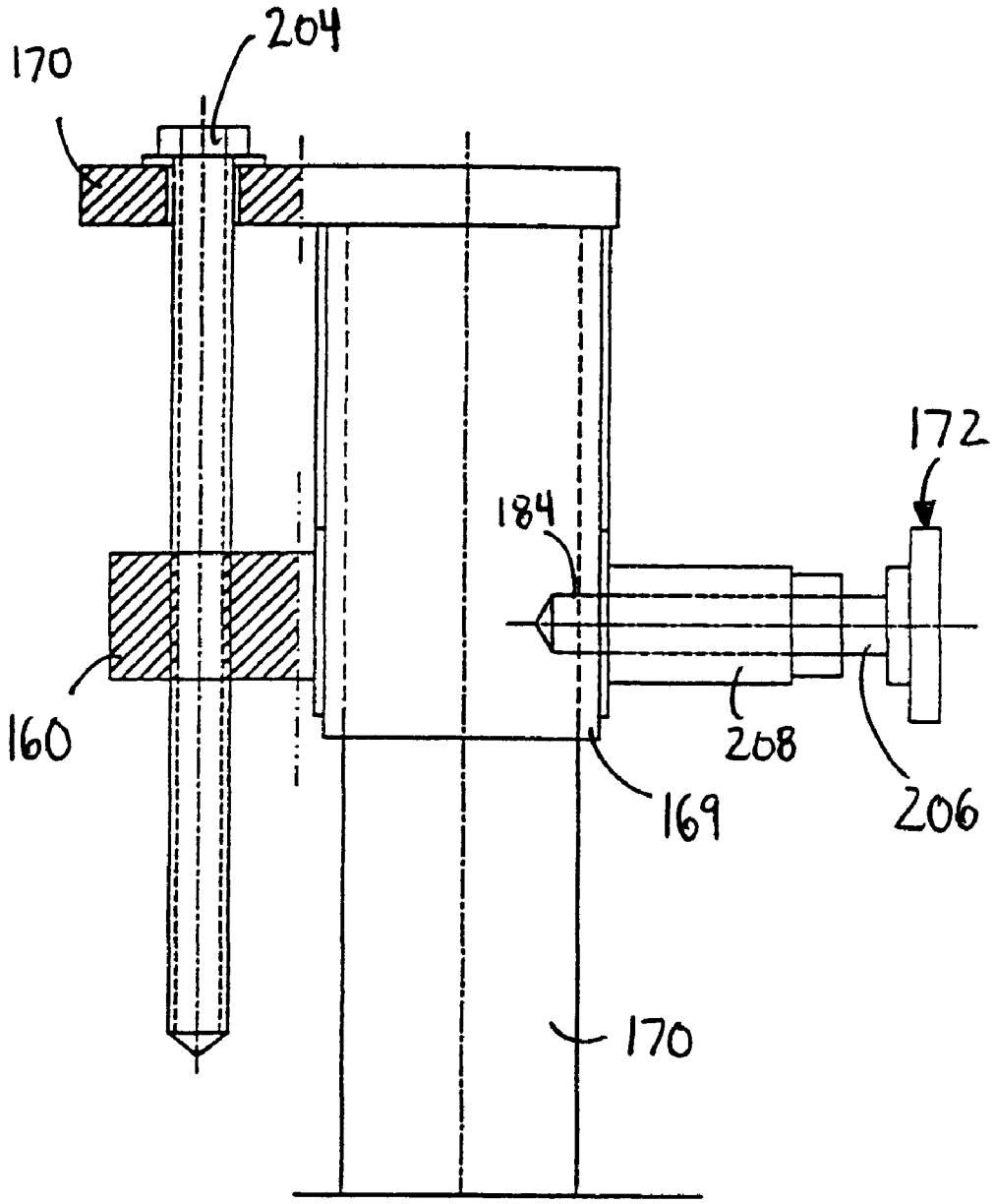
FIG. 16 is a front elevational view, partially in schematic, of the folding mechanism of FIG. 15.

As further shown in FIGS. 16 and 17, locking mechanism 172 includes a threaded member 206, for example a thumb screw, threadedly connected between the locking mechanism housing 208 and the center frame post 170 through an aperture 184, 186, or 188 shown in FIG. 12. The locking mechanism 172 is movable between a locked and an unlocked position upon threadedly rotating the threaded member 206 relative to the housing 208.

As may be recognized by those skilled in the pertinent art based on the teachings herein, any of the fastening devices, locking mechanisms, or relational movement dampening devices employed in a foldable trampoline of the present invention may take any of numerous different shapes, configurations, and/or types of such devices or mechanisms that are currently or later become known for performing the functions of the device or mechanism described herein. For example, a locking mechanism 172 alternatively can comprise a pin and handle device 212 as shown in FIG. 17.

One advantage of the relational movement dampening device described in connection with a foldable trampoline of the present invention is that the trampoline can be folded at a controlled rate to prevent an injury that may otherwise be caused when a foldable trampoline is folded and a resilient web is maintained in tension. Another advantage of the foldable trampoline described herein is that the foldable trampoline can form a relatively large backstop, including a horizontal catch area in addition to a vertical backstop area, suitable for a number of ball playing activities.

As may be recognized by those skilled in the pertinent art based on the teachings herein, numerous other changes and modifications may be made to the above-described and other embodiments of the present invention without departing from its scope as defined in the appended claims. Accordingly, this detailed description of preferred embodiments is to be taken in an illustrative, as opposed to a limiting sense.

What is claimed is:

1. A foldable trampoline, comprising:

a resilient web;

a web frame assembly including a first peripheral frame and a second peripheral frame connected to the first peripheral frame;

a plurality of springs connecting the resilient web to the first and second peripheral frames; and wherein at least one of the peripheral frames is pivotable relative to the other of the first and second peripheral frames to thereby pivot the resilient web and the web frame assembly between (i) a first position wherein the first and second peripheral frames and resilient web connected thereto are oriented in an approximately horizontal configuration forming a trampoline, (ii) a second position wherein at least one of the first and second peripheral frames and associated portion of the resilient web connected thereto are rigidly oriented at an angle of less than 180° relative the other of the first and second peripheral frames and associated portion of the resilient web connected thereto to thereby form a back stop for ball games, and (iii) a third position wherein the web frame assembly is compacted for transport and storage.

2. A foldable trampoline as defined in claim 1, wherein the first peripheral frame is pivotally connected to the second peripheral frame, and each of the first and second peripheral frames is pivotable between a first position with the associated portion of the web oriented approximately horizontal, and a second position pivoted upwardly relative to the first position.

3. A foldable trampoline as defined in claim 2, wherein the second position is approximately 90° relative to the first position.

4. A foldable trampoline as defined in claim 1, further comprising at least one locking device connected to at least one of the first and second peripheral frames for locking the respective frame and the associated portion of the resilient web in the first and second positions.

5. A foldable trampoline as defined in claim 1, further comprising a plurality of wheels rotatably mounted to the base frame for transporting the foldable trampoline.

6. A foldable trampoline as defined in claim 1, wherein each of the first and second peripheral frames defines a curvilinear shape.

7. A fold trampoline as defined in claim 6, each of the first and second peripheral frames defines an approximately semi-circular shape.

8. A foldable trampoline as defined in claim 1, wherein a plurality of the first peripheral frames include sockets for detachably mounting a plurality of legs oriented at approximately 90° from the first peripheral frames.

9. A foldable trampoline as defined in claim 1, further comprising a motion dampening device for facilitating folding the foldable trampoline, the motion dampening device being operatively connected to at least one of the first and second peripheral frames.

10. A foldable trampoline as defined in claim 9, wherein the motion dampening device includes a screw connected to the web frame assembly.

11. A foldable trampoline as defined in claim 9, wherein the motion dampening device includes a hydraulic cylinder connected to the web frame assembly.

12. An athletic apparatus for providing a trampoline and a back stop, the athletic apparatus comprising:

a resilient web for tumbling by a person and returning balls projected thereon;

a first frame portion for partially surrounding a first portion of the resilient web;

a second frame portion for partially surrounding a second portion of the resilient web;

a plurality of springs flexibly connecting the resilient web to the first and second frame portions;

a pair of pivot joints for connecting the first frame portion to the second frame portion, wherein the pivot joints allow adjustment of the first frame portion with respect to the second frame portion in a plurality of positions including an adjacent substantially parallel position for use as a trampoline and a substantially perpendicular position for use of the first portion as a back stop;

a locking mechanism for rigidly fixing the first frame portion with respect to the second frame portion in the adjacent substantially parallel position and the substantially perpendicular position; and a plurality of depending members attached to the first frame portion and the second frame portion for supporting the first frame portion and the second frame portion on a support surface.

13. An athletic apparatus as recited in claim 12, further comprising a pattern associated with the first portion of the resilient web for providing a target when used as a back stop.

14. An athletic apparatus as recited in claim 12, wherein the pivot joint allows for collapsing the first portion into an overlaid approximately parallel position with respect to the second frame portion for compact transport and storage.

15. An athletic apparatus as recited in claim 12, wherein the pivot joint includes:

a sleeve with a first aperture for hinging the first frame portion with respect to the second frame portion and a second aperture for locking the first frame portion with respect to the second frame portion;

a first fastening member extending through the first aperture and the first frame portion for rotationally coupling the first frame portion to the second frame portion; and a second fastening member detachably extending through the second aperture and the first frame portion for rigidly coupling the first frame portion to the second frame portion.

16. An athletic apparatus for providing a trampoline and a back stop, the athletic apparatus comprising:

first means for tumbling by a person and returning balls projected thereon;

second means for partially surrounding a first portion of the first means and supporting the first means;

third means for partially surrounding a second portion of the first means and supporting the first means;

fourth means for flexibly connecting the first means to the second and third means;

fifth means for connecting the second means to the third means and for allowing adjustment of the second means with respect to the third means in a plurality of positions including an adjacent approximately parallel position for use as a trampoline and an approximately perpendicular position for use of the second means and the first portion of the first means as a back stop;

sixth means for rigidly fixing the second means with respect to the third means in the adjacent approximately parallel position and the approximately perpendicular position; and seventh means for supporting the second and third means on a support surface.

17. An athletic apparatus as recited in claim 16, wherein:

the first means is defined by a resilient web for tumbling by a person and returning balls projected thereon;

the second means is defined by a first frame portion for partially surrounding a first portion of the resilient web; and the third means is defined by a second frame portion for partially surrounding a second portion of the resilient web.

18. An athletic apparatus as recited in claim 16, wherein:

the fourth means is defined by a plurality of springs flexibly connecting the resilient web to the first and second frame portions; and the sixth means is defined by a locking mechanism for rigidly fixing the first frame portion with respect to the second frame portion in the adjacent substantially parallel position and the substantially perpendicular position.

19. An athletic apparatus as recited in claim 16, wherein the fifth means is defined by a pair of pivot joints for connecting the second means to the third means, wherein the pivot joints allow adjustment of the second means with respect to the third means in a plurality of positions including the adjacent approximately parallel position for use as a trampoline and the approximately perpendicular position for use of the first portion as a back stop.

20. A foldable trampoline, comprising:

a resilient web;

a web frame assembly including a first peripheral frame and a second peripheral frame connected to the first peripheral frame;

a plurality of springs connecting the resilient web to the first and second peripheral frames wherein at least one of the peripheral frames is pivotable relative to the other of the first and second peripheral frames to thereby pivot the resilient web and the web frame assembly between (i) a first position wherein the first and second peripheral frames and resilient web connected thereto are oriented in an approximately horizontal configuration forming a trampoline, (ii) a second position wherein at least one of the first and second peripheral frames and associated portion of the resilient web connected thereto are rigidly oriented at an angle of less than 180° relative the other of the first and second peripheral frames and associated portion of the resilient web connected thereto to thereby form a back stop for ball games, and (iii) a third position wherein the web frame assembly is compacted for transport and storage; and at least one locking device connected to at least one of the first and second peripheral frames for locking the respective frame and the associated portion of the resilient web in the first and second positions wherein the at least one locking device has a lateral frame detachably connected on one end to the first peripheral frame and detachably connected on another end to the second peripheral frame.

21. A foldable trampoline, comprising:

a resilient web;

a web frame assembly including a first peripheral frame and a second peripheral frame connected to the first peripheral frame;

a plurality of springs connecting the resilient web to the first and second peripheral frames wherein at least one of the peripheral frames is pivotable relative to the other of the first and second peripheral frames to thereby pivot the resilient web and the web frame assembly between (i) a first position wherein the first and second peripheral frames and resilient web connected thereto are oriented in an approximately horizontal configuration forming a trampoline, (ii) a second position wherein at least one of the first and second peripheral frames and associated portion of the resilient web connected thereto are rigidly oriented at an angle of less than 180° relative the other of the first and second peripheral frames and associated portion of the resilient web connected thereto to thereby form a back stop for ball games, and (iii) a third position wherein the web frame assembly is compacted for transport and storage; and at least one locking device connected to at least one of the first and second peripheral frames for locking the respective frame and the associated portion of the resilient web in the first and second positions wherein the at least one locking device has a pivot joint pivotally connected at one end to the first peripheral frame and pivotally connected on another end to the second peripheral frame.

22. A foldable trampoline as defined in claim 21, wherein the pivot joint further comprises a means for locking the first and second peripheral frames in the first position and in the second position.

23. A foldable trampoline, comprising:

a resilient web;

a web frame assembly including a first peripheral frame and a second peripheral frame connected to the first peripheral frame;

a plurality of springs connecting the resilient web to the first and second peripheral frames;

a pivot joint, connecting the first peripheral frame with the second peripheral frame, for adjusting the first peripheral frame with respect to the second peripheral frame, wherein the first peripheral frame is pivotable relative to the second peripheral frame to thereby pivot the resilient web and the web frame assembly between (i) a first position wherein the first and second peripheral frames and resilient web connected thereto are oriented in an approximately horizontal configuration forming a trampoline and (ii) a second position wherein the web frame assembly is compacted for transport and storage; and a motion dampening device connected to the web frame assembly for safely moving the web frame assembly from the first position to the second position.

24. A foldable trampoline as recited in claim 23, wherein the motion dampening device includes a screw connected to the web frame assembly.

25. A foldable trampoline as recited in claim 24, wherein the motion dampening device includes a hydraulic cylinder connected to the web frame assembly.

* * * * *